US009422929B2

(12) United States Patent
Lee

(10) Patent No.: US 9,422,929 B2
(45) Date of Patent: Aug. 23, 2016

(54) ENERGY-SAVING SILENCER ASSEMBLY, A SEMICONDUCTOR MANUFACTURING VACUUM PUMP WITH SAME AND METHOD FOR HEATING NITROGEN GAS

(75) Inventor: Seung Yong Lee, Gyeonggi-Do (KR)

(73) Assignee: J-SOLUTION CO., LTD., Hwaseong-si, Gyeonggi-do (KR)

( * ) Notice: Subject to any disclaimer, the term of this patent is extended or adjusted under 35 U.S.C. 154(b) by 276 days.

(21) Appl. No.: 13/978,234

(22) PCT Filed: Dec. 28, 2011

(86) PCT No.: PCT/KR2011/010229

§ 371 (c)(1), (2), (4) Date: Jul. 3, 2013

(87) PCT Pub. No.: WO2012/093802

PCT Pub. Date: Jul. 12, 2012

(65) Prior Publication Data

US 2013/0287599 A1 Oct. 31, 2013

(30) Foreign Application Priority Data

Jan. 4, 2011 (KR) ..... 10-2011-0000590

(51) Int. Cl.
*F04B 39/00* (2006.01)
*F24H 3/12* (2006.01)
(Continued)

(52) U.S. Cl.
CPC ..... *F04B 39/005* (2013.01); *F01N 5/02* (2013.01); *F04D 19/04* (2013.01); *F04D 29/663* (2013.01);
(Continued)

(58) Field of Classification Search
CPC ..... F04B 39/0055; F04B 39/0072; F04B 39/005; F04C 29/06–29/068; F04D 29/66; F04D 29/661; F04D 19/04; F04D 29/663; F24H 3/12; F28D 7/026; F28D 7/106; F28D 7/103; Y10T 137/6525; F01N 5/02; F01N 2240/02
USPC ..... 417/312
See application file for complete search history.

(56) References Cited

U.S. PATENT DOCUMENTS 2,987,605 A * 6/1961 Brandl ..... 392/496
5,827,370 A * 10/1998 Gu ..... 118/715
(Continued)

FOREIGN PATENT DOCUMENTS

KR 10-1998-0041722 A 8/1998
KR 10-2000-0028109 A 5/2000
(Continued)

OTHER PUBLICATIONS

KR20050088649 translation; May 2009 by Ming, Byeong-Rong; Device of Supplying Hot Nitrogen Used in Processing of Semiconductor and Liquid Crystal Display.*
International Search Report for PCT/KR2011/010229 mailed Jun. 29, 2012 from Korean intellectual Property Office.

*Primary Examiner* — Peter J Bertheaud
*Assistant Examiner* — Dominick L Plakkoottam
(74) *Attorney, Agent, or Firm* — Paratus Law Group, PLLC

(57) ABSTRACT

The disclosure relates to an energy-saving silencer assembly, which includes: a silencer connected to a discharge side of a pump section, which pumps reaction by-product gas into a vacuum pump, so as to pass the pumped reaction by-product gas from a rear end portion to a front end portion; an outer pipe surrounding the outer peripheral surface of the silencer at an interval so as to provide a heating space between the silencer and the outer pipe; a nitrogen gas supply section for supplying nitrogen gas to the heating space; and a nitrogen gas injection section for injecting heated nitrogen gas to the inside of the silencer by the contact with the outer peripheral surface of the silencer in the heating space.

4 Claims, 5 Drawing Sheets

(51) Int. Cl.

| | |
|---|---|
| ***F01N 5/02*** | (2006.01) |
| ***F28D 7/02*** | (2006.01) |
| ***F04D 19/04*** | (2006.01) |
| ***F04D 29/66*** | (2006.01) |
| *F28D 7/10* | (2006.01) |

(52) U.S. Cl.

CPC *F24H 3/12* (2013.01); *F28D 7/026* (2013.01); *F28D 7/106* (2013.01); *F01N 2240/02* (2013.01); *F28D 7/103* (2013.01); *Y10T 137/6525* (2015.04)

(56) References Cited

U.S. PATENT DOCUMENTS 5,856,676 A * 1/1999 Rheem et al. ..... 250/492.21
6,371,737 B1 * 4/2002 Houze ..... 417/313

FOREIGN PATENT DOCUMENTS

KR 10-2005-0088649 A 9/2005
KR 20050088649 * 9/2005 ..... H01L 21/02

* cited by examiner

ENERGY-SAVING SILENCER ASSEMBLY, A SEMICONDUCTOR MANUFACTURING VACUUM PUMP WITH SAME AND METHOD FOR HEATING NITROGEN GAS

CROSS REFERENCE TO PRIOR APPLICATION

This application is a National Stage Patent Application of PCT International Patent Application No. PCT/KR2011/010229 (filed on Dec. 28, 2011) under 35 U.S.C. §371, which claims priority to Korean Patent Application No. 10-2011-0000590 (filed on Jan. 4, 2011), which are all hereby incorporated by reference in their entirety.

TECHNICAL FIELD

The present invention relates to a semiconductor manufacturing apparatus, and more particularly, to an energy-saving silencer assembly capable of solving a blockage problem caused by the solidification of byproducts and saving energy costs caused by the use of an additional heat source by using a high temperature of a surface of a silencer itself to heat nitrogen gas and supplying the heated nitrogen gas into the silencer, a semiconductor manufacturing vacuum pump having the energy-saving silencer assembly, and a method of heating nitrogen gas.

BACKGROUND ART

Generally, a semiconductor manufacturing process includes a fabrication process and an assembly process. The fabrication process means a process of manufacturing semiconductor chips by depositing thin films on a wafer in various process chambers and selectively etching the deposited films in a repeated way to form a predetermined pattern. The assembly process means a process of individually separating the chips manufactured in the fabrication process and then coupling the individual chip to a lead frame to assemble a final product.

At this time, the process of depositing thin films on a wafer or etching the films deposited on the wafer is performed at high temperature by using harmful gases such as silane, arsine, and boron chloride and process gases such as hydrogen in a process chamber. While such a process is performed, a large amount of various pyrophoric gases and byproduct gas containing harmful components and corrosive impurities are generated in the process chamber.

Thus, a semiconductor manufacturing apparatus is provided with a scrubber, which purifies byproduct gas discharged from a process chamber and discharges the purified byproduct gas to the atmosphere, at a downstream side of a vacuum pump for making the process chamber into a vacuous state.

However, while flowing from the process chamber to the vacuum pump and the scrubber via pipes 15*a* and 15*b* respectively, the harmful byproduct gas generated from the process chamber is easily solidified and accumulated, thereby resulting in blockage.

Thus, in order to solve the blockage problem caused by the solidification of byproduct gas, a nitrogen gas injection device 12 for injecting a high temperature nitrogen gas into a pipe in which a byproduct gas flows, particularly a pipe of a discharge side of a vacuum pump has been developed as disclosed in Korean Laid-open Patent Publication No. 2005-88649.

However, the conventional nitrogen gas injection device 12 which is provided as an external type had a limitation in that a blockage problem in a silencer 4 installed inside the vacuum pump is not solved. The silencer 4 is installed to suppress noise in the vacuum pump. However, since the silencer 4 is connected to a discharging portion 3 of a pump section 2 for performing pumping operation and thus positioned at a point which a large amount of byproducts pass through at once, the silencer 4 is always exposed to the blockage problem caused by the byproduct, but there is no obvious solution.

DISCLOSURE

Technical Problem

Accordingly, the present invention is conceived to solve the aforementioned problems in the prior art. An object of the present invention is to provide an energy-saving silencer assembly capable of solving a blockage problem caused by the solidification of byproducts and saving energy costs caused by the use of an additional heat source by using a high temperature of a surface of a silencer itself to heat nitrogen gas and supplying the heated nitrogen gas into the silencer, a semiconductor manufacturing vacuum pump having the energy-saving silencer assembly, and a method of heating nitrogen gas.

Technical Solution

According to an aspect of the present invention for achieving the objects, there is provided a silencer assembly of a semiconductor manufacturing vacuum pump for removing noise of byproduct gas pumped in the vacuum pump, which includes a silencer connected to a discharge side of a pump section for pumping byproduct gas in the vacuum pump and making the pumped byproduct gas pass through from a rear end portion to a front end portion; an outer pipe surrounding an outer peripheral surface of the silencer with a spacing therebetween to provide a heating space between the silencer and the outer pipe; a nitrogen gas supply section for supplying nitrogen gas to the heating space; and a nitrogen gas injection section for injecting into the silencer the nitrogen gas heated by being brought into contact with the outer peripheral surface of the silencer in the heating space.

The heating space may be further provided with a guide wire wound in a spiral around the outer peripheral surface of the silencer to guide the flow of nitrogen gas.

The nitrogen gas supply section may supply the nitrogen gas from a front end portion of the outer pipe, and the nitrogen gas injection section may inject the heated nitrogen gas at the rear end portion of the silencer.

The nitrogen gas supply section may be provided as a preheating pipe installed along a lengthwise direction from a rear end portion to the front end portion of the outer pipe in a position adjacent to an outer peripheral surface of the outer pipe, a nitrogen gas inlet port of the preheating pipe may be positioned at a rear end portion thereof, and a nitrogen gas outlet port for supplying the nitrogen gas to the heating space of the outer pipe may be positioned at the front end portion of the preheating pipe.

The nitrogen gas injection section may include a body defining a chamber surrounding an outside of the rear end portion of the silencer with a spacing therebetween to be supplied with the nitrogen gas heated from the heating space, and an injection nozzle for injecting the nitrogen gas introduced into the chamber into the silencer.

An injection hole of the injection nozzle may be formed in a position protruding from an inner peripheral surface of the silencer to inject the nitrogen gas in a flow direction of byproduct gas.

A semiconductor manufacturing vacuum pump according to the present invention includes the aforementioned silencer assembly.

A method of heating nitrogen gas according to the present invention, which is a method of heating nitrogen gas injected for preventing byproduct gas from being solidified, includes heating nitrogen gas supplied from the outside by being brought into contact with an outer peripheral surface of a silencer of a vacuum pump.

The nitrogen gas may be guided to flow in a spiral along the outer peripheral surface of the silencer.

The nitrogen gas may be preheated before being brought into contact with the outer peripheral surface of the silencer.

Advantageous Effects

According to an energy-saving silencer assembly, a semiconductor manufacturing vacuum pump having the same and a method of heating nitrogen gas of the present invention, it is possible to solve a blockage problem caused by the solidification of byproducts by using a high temperature of a surface of a silencer itself to heat nitrogen gas and supplying the heated nitrogen gas into the silencer.

In addition, according to the present invention, nitrogen gas is trapped in a limited space defined by a double pipe structure having an outer pipe surrounding the silencer with a spacing therebetween, thereby being capable of more effectively bringing the nitrogen gas into contact with an outer peripheral surface of the silencer.

Further, according to the present invention, a guide wire is provided so that the nitrogen gas can be in contact with a larger area of the outer peripheral surface of the silencer for a longer time.

Furthermore, according to the present invention, there is provided a preheating pipe for preheating nitrogen gas so that cold nitrogen gas is not brought into immediate contact with the surface of the silencer, thereby preventing the byproducts flowing in the silencer from being solidified.

BEST MODE

Hereinafter, preferred embodiments according to the present invention will be described in detail with reference to the accompanying drawings.

A silencer assembly according to the present invention, which is included in a semiconductor manufacturing vacuum pump, is configured so that nitrogen gas for preventing solidification of byproducts is heated without an additional heat source using the surface temperature of an outer peripheral surface of a silencer in a high temperature state. According to this configuration, since a heat source necessary for heating nitrogen gas need not be additionally provided, it is possible to save an enormous amount of energy.

Hereinafter, the configuration of the silencer assembly according to the present invention will be described.

Figure 1:
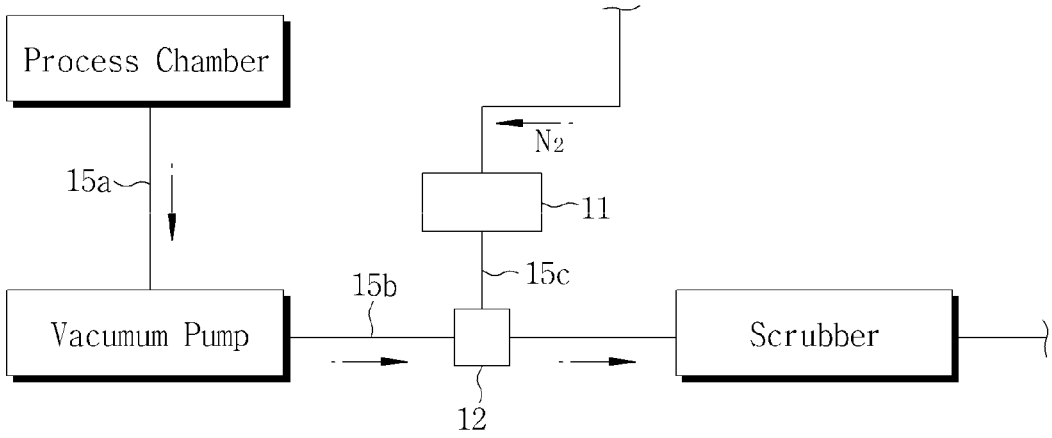
FIG. 1 is a view illustrating a prior art.
Figure 2:
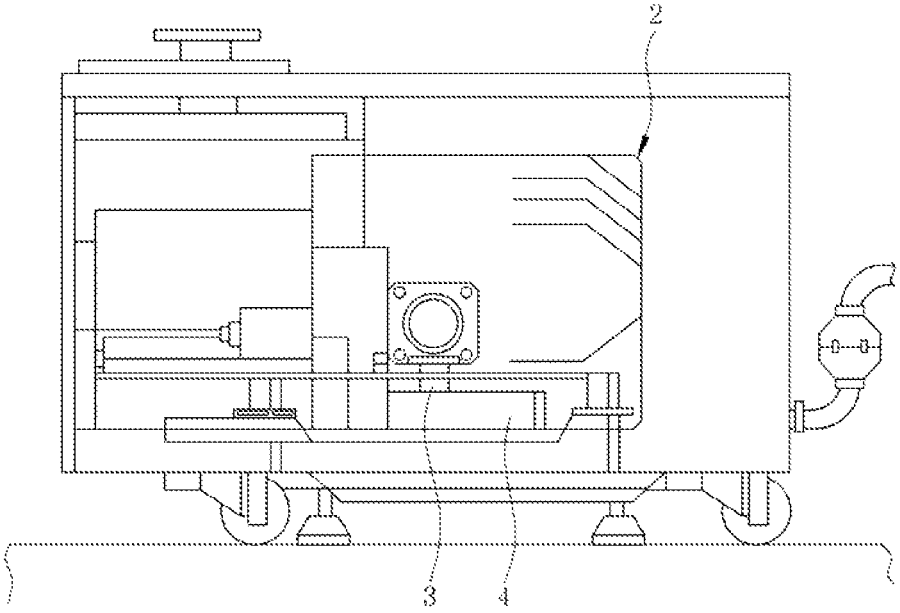
FIG. 2 is a view of the configuration of a vacuum pump illustrating the prior art.
Figure 3:
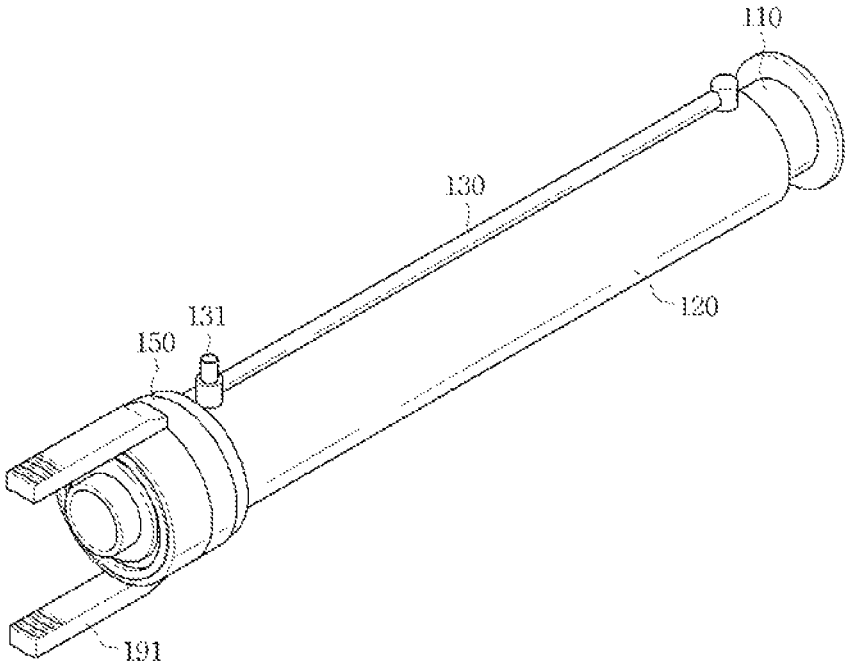
FIG. 3 is a perspective view of a silencer assembly according to the present invention.
Figure 4:
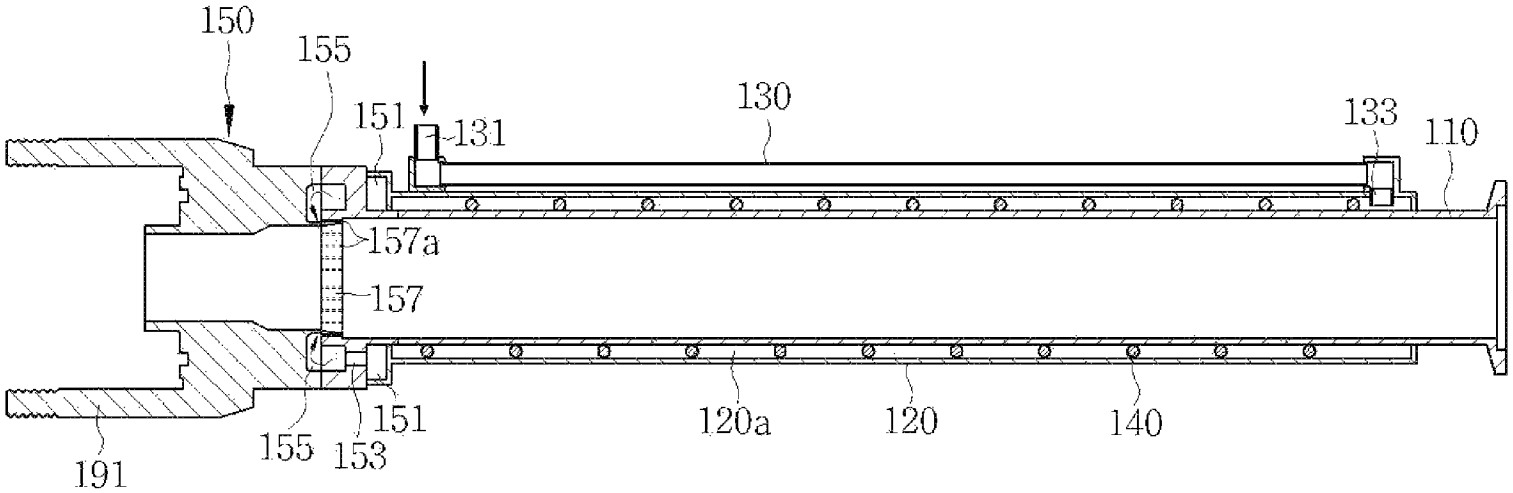
FIG. 4 is a sectional view illustrating the configuration of the silencer assembly according to the present invention.
Figure 5:
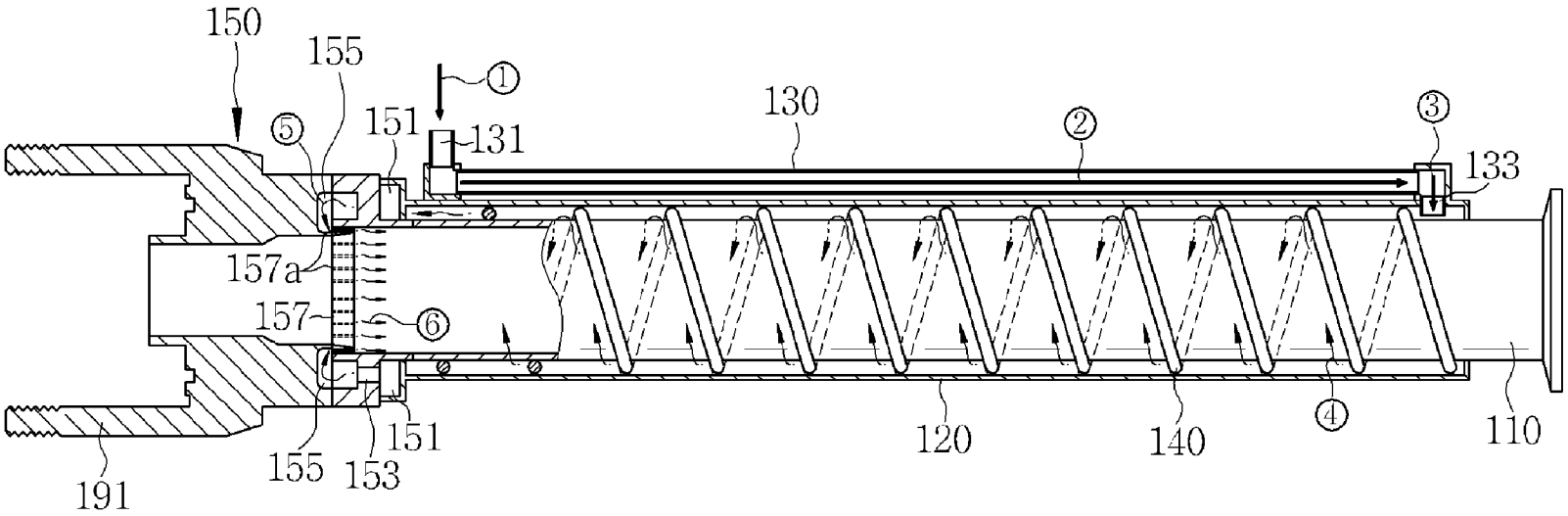
FIG. 5 is a partially cutaway view illustrating the operation of the silencer assembly according to the present invention.

FIG. 3 is a perspective view of a silencer assembly according to the present invention, and FIG. 4 is a sectional view illustrating the configuration of the silencer assembly according to the present invention.

As shown in the figures, the silencer assembly according to the present invention includes a silencer 110, an outer pipe 120 surrounding an outer peripheral surface of the silencer 110 with a spacing therebetween to define a heating space 120*a*, a preheating pipe 130 that is a nitrogen gas supply section for supplying nitrogen gas from the outside, a guide wire 140 for guiding the flow of nitrogen gas in the heating space 120*a*, and a nitrogen gas injection section 150 for injecting the nitrogen gas heated in the heating space 120*a* into the silencer 110.

The present invention including such components has a core feature in that the heating space 120*a* is provided by a double pipe structure consisting of the silencer 110 and the outer pipe 120 and nitrogen gas is introduced into the heating space 120*a* to be brought into contact with the outer peripheral surface of the silencer 110, thereby heating the nitrogen gas to a high temperature.

Hereinafter, the present invention will be described in more detail with a focus on the above components.

First, the silencer 110 is connected to a discharge side of a pump section for pumping byproduct gas in the vacuum pump to make the pumped byproduct gas pass through from a rear end portion to a front end portion.

In addition, the outer pipe 120 surrounds the outer peripheral surface of the silencer 110 with a spacing therebetween to provide the heating space 120*a* between the silencer 110 and the outer pipe 120. Accordingly, a double pipe structure having the heating space 120*a* is defined by the silencer 110 and the outer pipe 120, and the nitrogen gas injected into the heating space 120*a* is brought into contact with the outer peripheral surface of the silencer 110. In this case, the silencer 110 having a significantly high temperature in the vacuum pump as well known causes the nitrogen gas in contact with the outer peripheral surface of the silencer 110 to be smoothly heated to a high temperature.

The preheating pipe 130, which is the nitrogen gas supply section, performs a function of supplying nitrogen gas to the heating space 120*a* as described above. To this end, the preheating pipe 130 is installed along a lengthwise direction of the outer pipe 120 from the rear end portion to the front end portion of the outer pipe 120 in a position adjacent to an outer peripheral surface of the outer pipe 120. Here, a nitrogen gas inlet port 131 of the preheating pipe 130 is positioned at the rear end portion thereof, and a nitrogen gas outlet port 133 for supplying the nitrogen gas to the heating space 120*a* of the outer pipe 120 is positioned at the front end portion of the preheating pipe 130.

According to the configuration of the preheating pipe 130, before nitrogen gas supplied from the outside is introduced into the heating space 120*a*, the nitrogen gas is preheated in advance while flowing along the inner space of the preheating pipe 130. If the nitrogen gas is preheated before being introduced into the heating space 120*a*, it is possible to prevent the cold nitrogen gas from being brought into abrupt contact with the outer peripheral surface of the silencer 110. If the cold nitrogen gas is brought into immediate contact with the outer peripheral surface of the silencer 110, it is apprehended that the byproduct gas flowing in the silencer 110 is locally influenced thereby being solidified.

The nitrogen gas injection section 150 serves to inject into the silencer 110 the nitrogen gas heated by bringing it into contact with the outer peripheral surface of the silencer 110 in the heating space 120*a*. To this end, the nitrogen gas injection section 150 includes a body defining chambers 151 and 155 surrounding the outside of the rear end portion of the silencer 110 with a spacing therebetween to be supplied with the nitrogen gas heated from the heating space 120*a*, and an injection nozzle 157 for injecting the nitrogen gas introduced into the chambers 151 and 155 into the silencer 110.

Here, the body of the nitrogen gas injection section 150 is coupled to or provided integrally with the rear end portion of the silencer 110 and has a large hollow in communication with the silencer 110 in the center of the body. In addition, the chambers 151 and 155 of the body include the first chamber 151 and the second chamber 155 for successively receiving the nitrogen gas from the heating space 120*a*, and the two chambers 151 and 155 are in communication with each other through a communication hole 153.

Here, the injection nozzle 157 is provided with an injection hole 157*a*, which is formed to face the front in a position protruding from an inner peripheral surface of the hollow of the body of the nitrogen gas injection section 150. Such an injection hole 157*a* of the injection nozzle 157 can inject the nitrogen gas in the same direction as the flow direction of the byproduct gas flowing within the silencer 110 and have an ejector effect rather than hinder the flow of the byproduct gas by the injection of the nitrogen gas, thereby being capable of accelerating the flow of the byproduct gas.

The guide wire 140 is provided to be wound in a spiral around the outer peripheral surface of the silencer 110 in the heating space 120*a*. Here, the guide wire 140 has a thickness equal or similar to the height of the heating space 120*a*. If the guide wire 140 is provided as described above, the nitrogen gas flowing in the heating space 120*a* flows not simply straight but in a spiral along the outer peripheral surface of the silencer 110 while being guided by the guide wire 140. Thus, the contact area and the contact time of the nitrogen gas with the surface of the silencer 110 in the heating space 120*a* are increased, thereby improving heat exchange efficiency.

For reference, unmentioned reference numeral 191 designates a connector for connecting to the pump section.

The operation of the silencer assembly according to the present invention will be described in detail with reference to the accompanying drawings.

First, in a state that the vacuum pump operates, the silencer 110 reaches a state heated to a high temperature by a high temperature atmosphere in the vacuum pump.

If the silencer 110 itself is heated to a high temperature as described above, the heating space 120*a* defined between the silencer 110 and the outer pipe 120 also has a high temperature atmosphere, and although having a lower temperature than that, the preheating pipe 130 communicating with the heating space 120*a* also has a relatively high temperature atmosphere.

In such a state, if nitrogen gas is supplied to the preheating pipe 130 from the outside (①), before the nitrogen gas is introduced into the heating space 120*a*, the nitrogen gas is preheated and a first temperature increase is achieved while flowing in the preheating pipe 130 (②).

Thereafter, the nitrogen gas having the first temperature increase achieved in the preheating pipe 130 is introduced into the heating space 120*a* defined between the silencer 110 and the outer pipe 120 through the nitrogen gas outlet port 133 at the front end portion of the preheating pipe 130 (③).

Then, the nitrogen gas introduced into the heating space 120*a* flows backward while being in contact with the outer peripheral surface of the silencer 110 in the heating space 120*a* (④). In such a case, the nitrogen gas introduced into the heating space 120*a* flows in a spiral along the guide wire 140 and thus the contact area and the contact time with the silencer 110 are increased.

As described above, the nitrogen gas introduced into the heating space 120*a* flows while being in contact with the high temperature outer peripheral surface of the silencer 110 and then becomes in a state heated to a significantly high temperature when the nitrogen gas reaches the rear end portion of the heating space 120*a*.

Thereafter, the nitrogen gas heated at a high temperature in the heating space 120*a* passes through the first chamber 151 and the second chamber 155 of the body of the nitrogen gas injection section 150 (⑤) and then is injected into the silencer 110 through the injection hole 157*a* of the injection nozzle 157 (⑥). The nitrogen gas injected in this way is injected in the same direction as the flow direction of the byproduct gas flowing within the silencer 110 and thus is mixed with the byproduct gas without hindering the flow thereof, thereby preventing the solidification of the byproduct gas and helping the byproduct gas flow by the ejector effect.

Although the preferred embodiments of the present invention have been described, the present invention may use various changes, modifications and equivalents. It will be apparent that the present invention may be equivalently applied by appropriately modifying the aforementioned embodiments. Accordingly, the above descriptions do not limit the scope of the present invention defined by the appended claims.

The invention claimed is:

1. A silencer assembly of a semiconductor manufacturing vacuum pump for removing noise of byproduct gas pumped in the vacuum pump, the silencer assembly comprising:

a silencer connected to a discharge side of a pump section for pumping byproduct gas in the vacuum pump and making the pumped byproduct gas pass through from a first end portion connected to the discharge side to a second end portion being positioned opposite to the first end portion;

an outer pipe surrounding an outer peripheral surface of the silencer with a spacing therebetween to provide a heating space formed between the outer peripheral surface of the silencer and the outer pipe, the heating space directly contacting with the outer peripheral surface of the silencer and including a first inlet through which nitrogen gas is inserted into the heating space and a first outlet through which the nitrogen gas is discharged from the heating space, wherein the first inlet is positioned adjacent to the second end portion of the silencer and the first outlet is positioned adjacent to the first end portion of the silencer such that the nitrogen gas flowing from the first inlet to the first outlet through the heating space is heated by a first heat exchange through the outer peripheral surface of the silencer with the pumped byproduct gas passing through the silencer;

a guide wire wound in a spiral directly on and around the outer peripheral surface of the silencer in the heating space such that the nitrogen gas inserted into the heating space through the first inlet moves on the outer peripheral surface of the silencer along the guide wire toward the first outlet;

a nitrogen gas supply section for supplying nitrogen gas to the heating space, the nitrogen gas supply section including a preheating pipe installed on the outer pipe along a lengthwise direction of the outer pipe from the first end portion to the second end portion, the preheating pipe including a second inlet through which the nitrogen gas is inserted into the preheating pipe and a second outlet through which the nitrogen gas is discharged from the preheating pipe toward the first inlet of the outer pipe, wherein the second inlet is positioned adjacent to the first end portion of the silencer and the second outlet is positioned adjacent to the second end portion of the silencer to communicate with the first inlet of the outer pipe such that the nitrogen gas flowing from the second inlet to the second outlet through the preheating pipe is heated by a second heat exchange through the outer pipe with the nitrogen gas flowing through the heating space in the outer pipe; and a nitrogen gas injection section installed adjacent to the first end portion of the silencer for injecting into the silencer the nitrogen gas heated by the first and second heat exchanges and then received from the first outlet of the outer pipe.

2. The silencer assembly according to claim 1, wherein the nitrogen gas injection section includes a body defining a chamber surrounding an outside of the first end portion of the silencer with a spacing therebetween to be supplied with the nitrogen gas heated from the heating space, and an injection nozzle for injecting the nitrogen gas introduced into the chamber into the silencer.

3. The silencer assembly according to claim 2, wherein an injection hole of the injection nozzle is formed in a position protruding from an inner peripheral surface of the silencer to inject the nitrogen gas in a flow direction of the byproduct gas.

4. A semiconductor manufacturing vacuum pump comprising the silencer assembly according to claim 1.

* * * * *